United States Patent [19]

Bosshart

[11] Patent Number: 4,969,281

[45] Date of Patent: Nov. 13, 1990

[54] HYDRAULIC SYSTEM FOR LAUNDRY FLATWORK IRONER

[75] Inventor: John Bosshart, Fort Lauderdale, Fla.

[73] Assignee: Jensen Corporation, Fort Lauderdale, Fla.

[21] Appl. No.: 255,737

[22] Filed: Oct. 11, 1988

[51] Int. Cl.[5] ..... D06F 63/00

[52] U.S. Cl. ..... 38/047; 38/52; 60/488; 92/13.1

[58] Field of Search ..... 60/487, 488, 444; 92/13.1, 13.3; 38/47, 52

[56] References Cited

U.S. PATENT DOCUMENTS

| | | | |
|---|---|---|---|
| 3,371,483 | 3/1968 | Gray et al. | 60/444 X |
| 3,484,966 | 12/1969 | Gruner et al. | 38/55 |
| 3,992,883 | 11/1976 | Cope | 60/456 |
| 3,995,425 | 12/1976 | Wittren | 60/445 |
| 4,420,935 | 12/1983 | Kobald et al. | 60/427 |
| 4,488,365 | 12/1984 | Hord et al. | 38/47 |
| 4,571,941 | 2/1986 | Aoyagi et al. | 60/444 X |

FOREIGN PATENT DOCUMENTS

| | | | |
|---|---|---|---|
| 564165 | 6/1957 | Italy | 60/456 |

*Primary Examiner*—Edward K. Look
*Assistant Examiner*—John E. Ryznic
*Attorney, Agent, or Firm*—Oltman and Flynn

[57] ABSTRACT

A hydraulic system for operating the rollers and one or more steam chests in a laundry flatwork ironer. A two-way, variable delivery, high pressure, main pump operates a hydraulic motor driving the ironer rollers. A one-way, fixed delivery, charge pump keeps the hydraulic circuit between the main pump and the hydraulic motor fully charged. The charge pump also powers a hydraulic control circuit for the main pump and controls the operation of steam chest lift cylinders. The control circuit for the main pump has a positioning cylinder and a speed control cylinder which jointly control the direction and delivery rate of the main pump, thereby controlling the direction and speed of the ironer rollers. The control circuit has a solenoid valve for stopping the hydraulic motor in an emergency and a solenoid valve for selectively controlling the speed of the chest lift cylinders.

9 Claims, 3 Drawing Sheets

HYDRAULIC SYSTEM FOR LAUNDRY FLATWORK IRONER

SUMMARY OF THE INVENTION

This invention relates to a hydraulic system for driving the rollers and raising a steam chest in a laundry flatwork ironer.

in the present system the rollers are driven by a hydraulic motor and the steam chest is raised by hydraulic cylinder-and-piston units. In this respect, the present system is similar to the one shown in U.S. Pat. No. 4,488,365 to Charles F. Hord and William W. Allen, which is assigned to the same assignee as the present invention. However, the present system differs from the system of U.S. Pat. No. 4,488,365 in the manner in which the hydraulic motor is supplied with pressurized hydraulic liquid to power it and in the manner in which the steam chest lift cylinders are supplied with hydraulic liquid to operate them.

The present system uses a known type of pump assembly having a main pump and a charge pump. The main pump is a two-way, variable delivery, high pressure pump. The charge pump is a one-way, fixed delivery pump. In the present system, the hydraulic motor which drives the ironer rollers is driven by hydraulic fluid pumped by the main pump, and the charge pump keeps the hydraulic lines between the main pump and the hydraulic motor fully charged with hydraulic liquid. The charge pump also supplies hydraulic liquid to a control circuit which controls the operation of the main pump and also the operation of hydraulic cylinder-and-piston units for raising one or more steam chests in the ironer. Preferably, this control system has a positioning cylinder and a speed control cylinder which control the direction and flow delivery rate of the main pump, thereby controlling the direction and speed of the hydraulic motor, and solenoid valves which control the operation of the positioning and speed control cylinders. Preferably, also, the control circuit has another solenoid valve which may be operated to stop the hydraulic motor in case of an emergency. Preferably, also, the control circuit has solenoid valves controlling the operation of steam chest lift cylinders and a solenoid valve which determines the fluid pressure applied to these lift cylinders.

A principal object of this invention is to provide a novel hydraulic system for a laundry flatwork ironer.

Another object of this invention is to provide such a system which has a novel arrangement for controlling the direction and speed of the rollers in the ironer.

Another object of this invention is to provide such a system which has a novel arrangement for controlling the operation of lift cylinders for one or more steam or thermal chests in the ironer.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
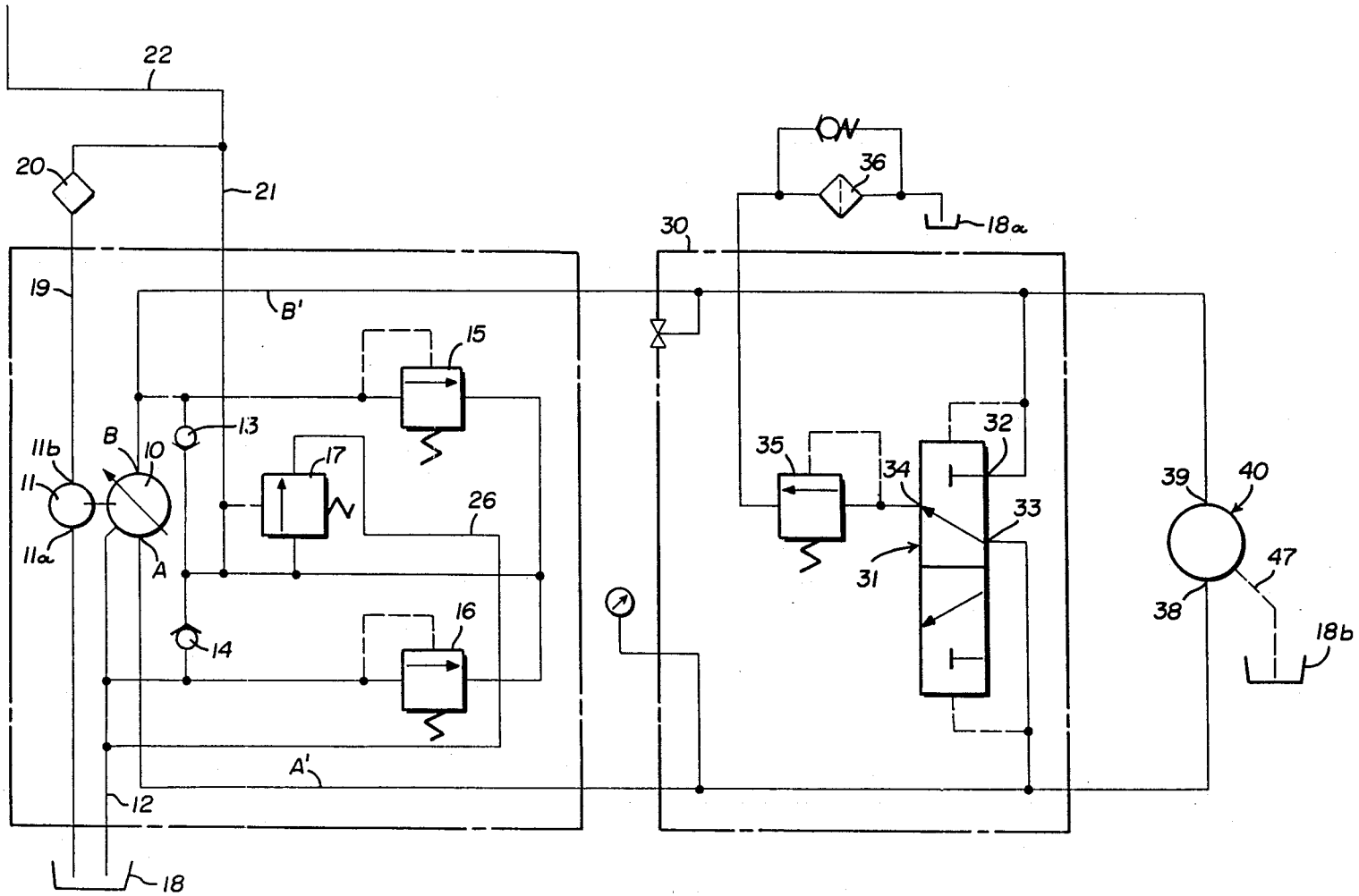
FIG. 1 is a schematic hydraulic circuit diagram showing the part of the present system which powers the hydraulic motor for driving the rollers in a laundry flatwork ironer.

FIG. 1 shows a hydraulic circuit which embodies a two-pump apparatus of known design which is sold under the name HYDRA® by the Oilgear Company and is described in its Bulletin HW-6. This two-pump apparatus includes a two-way, variable delivery, high pressure pump 10, hereinafter referred to as the "main pump", and a one-way, fixed delivery gear pump 11, herein-after referred to as the "charge pump" or "second pump". This two-pump apparatus is connected in a hydraulic circuit which also includes two check valves 13 and 14, two high pressure relief valves 15 and 16, and a low pressure relief valve 17.

The charge pump 11 has an inlet port at 11*a* which is connected to a reservoir 18 holding hydraulic fluid. The charge pump has an outlet port at 11*b* which is connected by conduit 19 to the inlet port of a cooler 20 of known design. The outlet port of the cooler is connected to a conduit 21 which is the supercharge inlet line for the main pump 10. The cooler outlet port also is connect by a conduit 22 to the seven-station assembly shown in FIG. 2 and described in detail hereinafter.

The main pump 10 is piston pump having an adjustable body inside whose position determines which port A or B of this pump is the inlet and which is the outlet and also determines the delivery rate of the pump. The position of this adjustable body is determined by a rotatably adjustable pintle, as described in detail herein after with reference to FIG. 3. The casing of the main pump is connected to reservoir 18 by drain line 12. Pump port A is connected to a conduit of line A′ and pump port B is connected to a conduit of line B′.

The supercharge inlet line 21 is connected to port B of main pump 10 through check valve 13 and to port A through check valve 14.

Port B of the main pump is connected to the inlet side of high pressure relief valve 15, the outlet side of which is connected to supercharge inlet line 21. Similarly, port A of the main pump is connected to the inlet side of high pressure relief valve 16, the outlet side of which is connected to supercharge inlet line 21.

The low pressure relief valve 17 has its inlet side connected to supercharge inlet line 21 and its outlet side connected to reservoir 18 via lines 26 and 12.

Ports A and B of main pump 10 are connected via the respective conduits A′ and B′ to respective inlets of a hot oil valve sub-assembly enclosed in the dashed-line box 30 in FIG. 1. Thus sub-assembly includes a shuttle valve 31 having two inlets 32 and 33 and a single outlet 34. The inlet 32 of shuttle valve 31 is connected to conduit B′ coming from port B of main valve 10. The other inlet 33 of shuttle valve 31 is connected to conduit A′ coming port A of main valve 10. The hot oil valve sub-assembly 30 has a low pressure relief valve 35 connected between the shuttle valve's outlet 34 and the inlet side of a filter 36, the outlet of which is connected to a reservoir 18*a*, which preferably is the same reservoir as the supply reservoir 18 for a charge pump 11 but is shown separately in FIG. 1 for convenience of illustration. Low pressure relief valve 35 is set to open at a lower pressure than low pressure relief valve 17.

Shuttle valve 31 operates in response to the output pressure of main pump 10 in line A′ or line B′. When the main pump's output is connected to line A′, shuttle valve 31 assumes the "forward" shift position in which it blocks inlet port 33 and connects inlet port 32 to outlet port 34. Conversely, when the main pump's output is connected to line B′, shuttle valve assumes the "reverse" shift position in which its inlet port 32 is blocked and its inlet port 33 is connected to outlet port 34.

Top the right of the hot oil valve sub-assembly 30 in FIG. 1, conduits A′ and B′ are connected to respective ports 38 and 39 of a reversible hydraulic motor 40. The casing of this motor has a drain line 47 connected to a reservoir 18*b*, which also preferably is the same reservoir as supply reservoir 18. Motor 40 is the drive motor for rollers in the ironer. When port A is the outlet port of the main pump 10, shuttle valve 31 is in its forward shift position, disconnecting its inlet port 33 from outlet port 34, and the hydraulic pressure in conduit A′ is applied to port 38 of motor 40, causing it to operate in the direction for driving the ironer rollers forward. When port B is the outlet port of main pump 10, shuttle valve 31 is in its reverse shift position, blocking its inlet port 32 and connecting inlet port 33 to outlet port 34, the hydraulic pressure in conduit B′ is applied to port 39 of motor 40, causing it to operate in the opposite direction and drive the ironer roller in reverse.

The speed at which hydraulic motor 40 is driven depends, of course, on the flow rate from main pump 10. As already explained, the flow rate is variable depending upon the position of its adjustable body.

Figure 3:
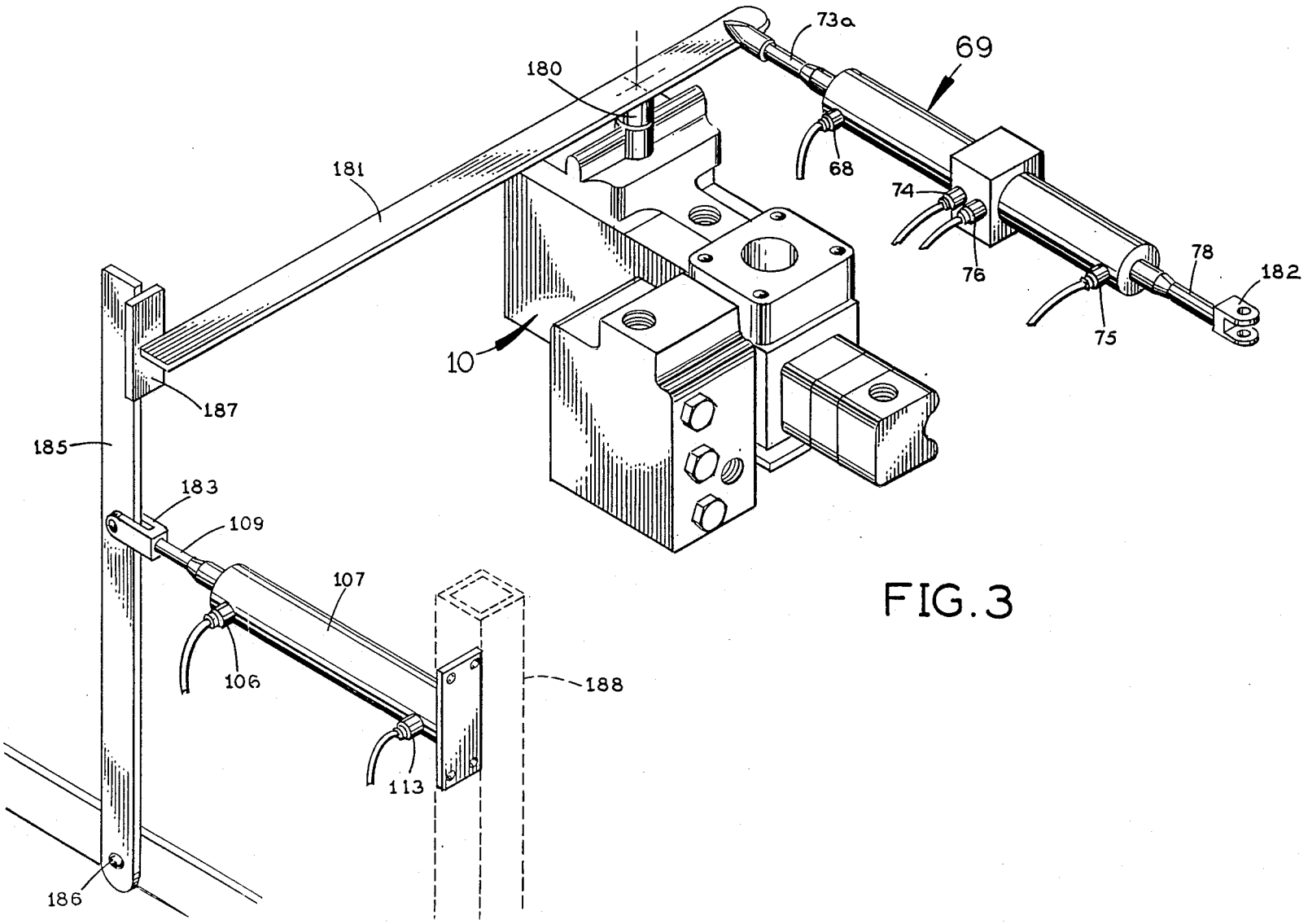
FIG. 3 is a perspective view showing the mechanical linkage between (1) the positioning cylinder and the speed control cylinder in FIG. 2 and (2) the pump in FIG. 1 whose output powers the hydraulic motor.

Referring to FIG. 3, the main pump 10 has a rotatably adjustable pintle 180 extending up from a rotatably adjustable body inside the pump casing which controls both the direction and the delivery rate of the pump. Preferably, this main pump is as shown in bulletin HW-6 of the Oilgear Company.

A horizontal lever 181 is attached to the top of pintle 180 and controls its rotational or angular position. On one side of the pintle, lever 181 is coupled to one piston rod 73*a* coming out of a "positioning cylinder" 69, whose operation is described later with reference to FIG. 2. Another piston rod 78 extends from the opposite end of cylinder 69 and is attached pivotally by a yoke 182 to a fixed support rail (not shown). the "positioning cylinder" is a double cylinder-and-piston unit having two segregated cylinders arranged end-to-end and each having a slidable piston connected to a respective piston rod 73*a* or 78.

The overall length of the "positioning cylinder" is reduced by retracting piston rod 73*a* (from left to right in FIG. 3.) This causes lever 181 and pintle 180 to turn clockwise in FIG. 3, which causes main pump 10 to operate in its forward direction. The delivery rate of the pump depends upon how far its pintle 180 turns in this "forward" direction.

The overall length of the "positioning cylinder" 69 is increased by causing its cylinder to move away from the fixed outer end of its other piston rod 78 (i.e., to the left in FIG. 3). This causes lever 181 and piston 180 to turn counter-clockwise in FIG. 3, which causes main pump 10 to operate in its reverse direction. The delivery rate of the pump depends upon how far its pintle 180 is turned in this "reverse" direction.

Whether the pump pintle 180 can be turned in the "forward" direction, and how far, are determined by a "speed control" cylinder 107, which has a piston slidable therein and connected to a piston rod 109. A yoke 183 on the outer end of this piston rod is pivotally coupled at 184 to a stop lever 185. The stop lever is pivoted at 186 at its lower end, and near its upper end it carries a stop plate 187 which is positioned in the path of movement of the outer end of lever 181 in the clockwise ("forward") direction. Cylinder 107 is fixedly supported by a support rail 188 at its end remote from piston rod 109.

When the piston rod 109 is fully retracted (to the right in FIG. 3), it positions the stop plate 187 to prevent the main pump 10 from operating in its forward direction. When piston rod 109 is extended from this fully-retracted position, it permits the main pump to operate in its forward direction and to pump at a fluid displacement rate which is determined by how far this piston rod is extended.

Figure 2:
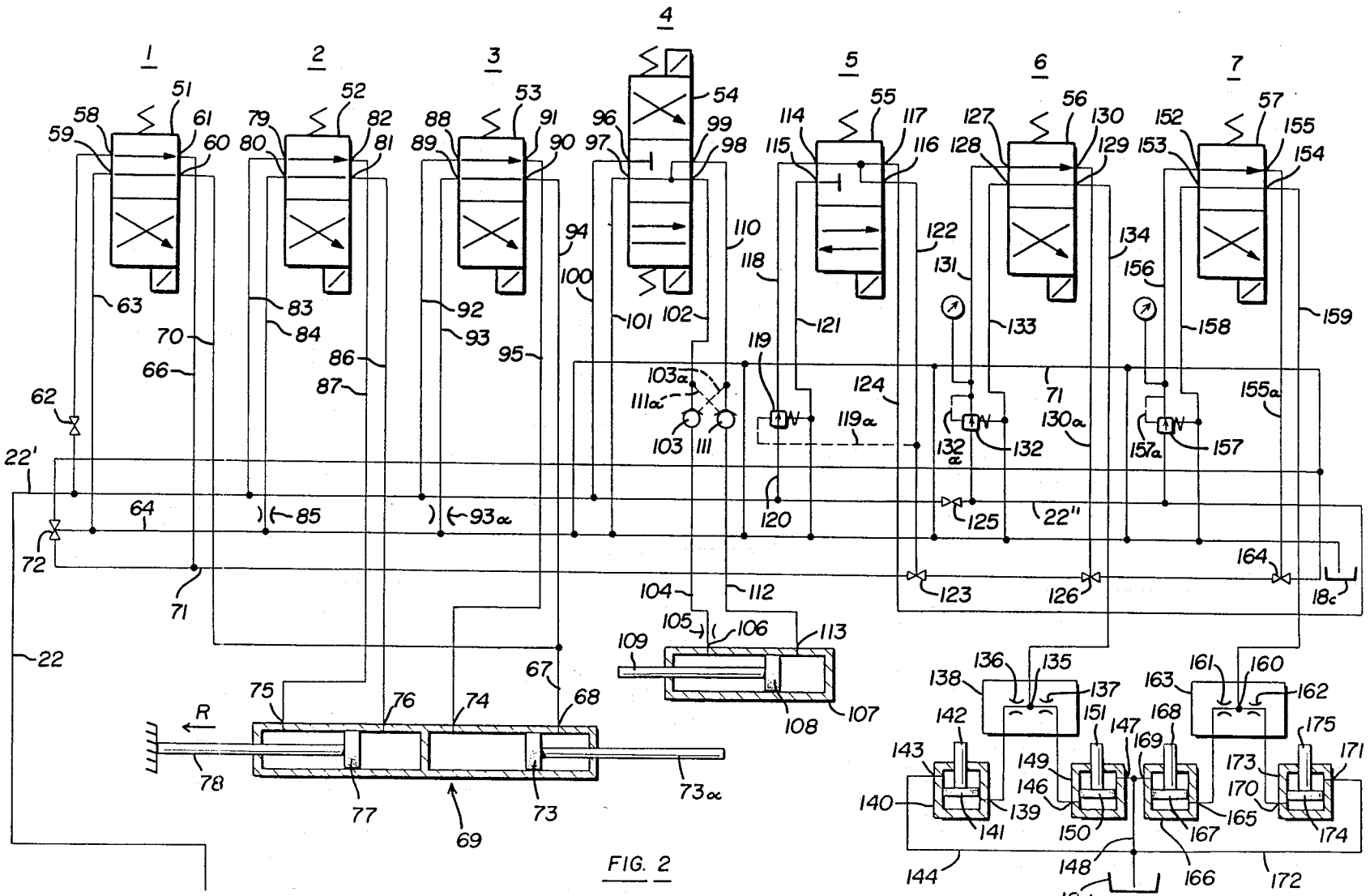
FIG. 2 is a schematic hydraulic circuit diagram showing the part of the present system which (1) controls the pump in FIG. 1 whose output powers the hydraulic motor and (2) controls the operation of the steam chest lift cylinders.

Referring to FIG. 2, the ironer control system has seven stations, each having a solenoid valve. Stations 1,2,3 and 4 relate to the roller drive arrangement in the ironer. Stations 5,6 and 7 relate to the ironer's arrangement for raising and lowering steam chests toward and away from the rollers. The solenoid valve 51 at station 1 controls "run" and "emergency stop" functions of the roller drive. The solenoid valve 52 at station 2 relates to the "reverse" function of the roller drive. At station 3 the solenoid valve 53 relates to the "forward" drive function for the rollers. At station 4 the solenoid valve 54 determines the speed at which the ironer rollers are driven. Solenoid valve 55 at station 5 relates to an "energy saver" mode of operating the steam chests. At stations 6 and 7 the respective solenoid valves 56 and 57 control the up and down movements of steam chests in the ironer. Each solenoid valve 51,52,53, 55,56 and 57 is a single solenoid valve which has two different flow conditions, one when the solenoid is de-energized and the other when the solenoid is energized. The speed control solenoid valve 54 has two solenoids and three possible flow conditions-one when neither solenoid is energized, a second when one solenoid but not the other is energized, and a third when the other but not the one is energized. The heavy line 22′ designates a fluid pressure manifold which receives hydraulic liquid from the charge or second pump 11 in FIG. 1 via line 22 in FIGS. 1 and 2.

It is to be understood that the ironer may have just one steam chest, in which case one of the two steam chest solenoid valves 56 or 57 would be omitted, or it may have three or more steam chests, each controlled by its own solenoid valve.

The "run/emergency stop" solenoid valve 51 has a first port 58, drain port 59, and third and fourth ports 60 and 61, which coummunicate alternately and reversibly with ports 58 and 59 individually. A first isolating plug 62 is connected between pressure manifold 22′ and the first port 58 of this valve, blocking fluid flow between them. Drain port 59 is connected via lines 63 and 64 to a reservoir 18*c*, which preferably is the same reservoir as the pump supply reservoir in FIG. 1. Port 60 is connected through lines 66 and 67 to one port 68 of positioning cylinder 69. Port 61 is connected through line 70 to a plugged port 72.

When the solenoid of valve 51 is de-energized, its first port 58 is connected to its port 61 and its drain port 59 is connected to its port 60. When the solenoid of valve 51 is energized, its first port 58 is connected to its port 60 and its drain port 59 is connected to its port 61.

The positioning cylinder 69 has two hydraulically separate cylinders, shown end-to-end in FIG. 2. The aforementioned cylinder port 68 is in the cylinder which slidably receives a piston 73 which is connected to the previously-mentioned piston rod 73*a*. This cylinder has a second port 74 spaced from its port 68. The other cylinder of positioning cylinder 69 has two ports 75 and 76 and it slidably receives a piston 77 which is connected to the previously-mentioned piston rod 78. The outer end of this piston rod is fixed by its pivotal attachment to a fixed support rail.

At station 2 the "reverse drive" solenoid valve 52 has a pressure port 79, an outlet port 80, and two additional ports 81 and 82, one of which is an inlet port and the other of which is an outlet port, depending upon whether or not the solenoid of that valve is energized. The pressure port 79 is connected via line 83 to the pressure manifold line 22'. The outlet port 80 is connected via line 84 and a flow-restricting orifice 85 to line 64 leading to reservoir 18*c*. Port 81 of solenoid valve 52 is connected via line 86 to port 76 of positioning cylinder 69. Port 82 in connected via line 87 to port 75 of positioning cylinder 69.

When the solenoid of valve 52 is de-energized, its pressure port 79 is connected to its port 82 and its outlet port 80 is connected to its port 81. When the solenoid of valve 52 is energized, its inlet port 79 is connected to its port 81 and its outlet port 80 is connected to its port 82.

At station 3 the "forward drive" solenoid valve 53 has a pressure port 88, an outlet port 89, and two additional ports 90 and 91, one of which is an inlet port and the other of which is an outlet port, depending upon whether or not the solenoid of valve 53 is energized. Pressure port 88 is connected via line 92 to pressure manifold 22'. Outlet port 89 is connected via line 93 and a flow restriction 93*a* to line 64 leading to reservoir 18*c*. Port 90 is connected via lines 94 and 67 to port 68 of positioning cylinder 69. Port 91 is connected via line 95 to port 74 of this cylinder.

At station 4 the "speed control" valve 54, which has two solenoids controlling its operation, has a pressure port 96, a drain port 97, and two additional ports 98 and 99. Pressure port 96 is connected via line 100 to the pressure manifold 22'. Drain port 97 is connected via lines 101 and 64 to the reservoir 18*c*. Port 98 is connected via line 102, check valve 103, line 104 and flow restriction orifice 105 to one port 106 of the previously-mentioned speed control cylinder 107, which slidably receives a piston 108 having piston rod 109. Port 99 is connected via line 110, check valve 111 and line 112 to another port 113 of cylinder 107. Check valves 103 and 111 together constitute a pilot-operated dual check valve assembly. Both have soft seats to prevent leakage. The pilot pressure for opening check valve 103 is the pressure in line 110, as indicated by the dashed line 103*a* in FIG. 2. The pilot pressure for opening check valve 111 is the pressure in line 102, as indicated by the dashed line 111*a*.

When neither solenoid of valve 54 is energized, its pressure port 96 is blocked from both ports 98 and 99, and ports 98 and 99 are both corrected to drain port 97. When the "faster" (lower) solenoid of valve 54 is energized, its pressure port 96 is connected to port 99 and its drain port 97 is connected to port 98. When the "slower" (upper) solenoid of valve 54 is energized, tis pressure port 96 is connected to line 98 and its drain port 97 is connected to port 99.

At station 5 the "energy saver/normal" solenoid valve 55 has an inlet port 114, a drain port 115, and two additional ports 116 and 117. Inlet port 114 is connected via line 118 to the outlet side of a pressure regulating valve 119, the inlet of which is connected via line 120 to the pressure manifold 22'. Drain port 115 of valve 55 is connected via lines 121 and 64 to the reservoir 18*c*. Port 116 is connected via a line 122 to an isolating plug 123, which blocks it. Port 117 is connected via line 124 to a pressure manifold 22" which is blocked from pressure manifold 22' by an isolating plug 125. Manifold 22" is the pressure manifold for the cylinder-and-piston units which raise the steam chests in the ironer. As indicated by the dashed line 119*a*, the pressure regulating valve 119 senses the pressure in line 122 and limits the pressure in line 118 to a predetermined value, such as 85 psi. Whenever the pressure in line 122 begins to exceed this predetermined pressure, regulating valve 119 dumps the excess input pressure to drain line 121.

When the solenoid of valve 55 is de-energized, its inlet port 114 is connected to both of its ports 116 and 117, and its drain port 115 is blocked. When the solenoid of valve 55 is energized, its inlet port 114 is connected to its port 117 and its drain port 115 is connected to its port 116. Thus, manifold 22" is connected to pressure manifold 22' through valve 55 whether or not its solenoid is energized.

Stations 6 and 7 are supplied with hydraulic liquid by the pressure manifold 22" connected to line 124 coming from solenoid valve 55 at station 5.

At station 6, the control valve 56 for the second steam chest in the ironer is a solenoid valve having a pressure port 127, a drain port 12B, and two additional ports 129 and 130 which communicate alternately and reversibly with ports 127 and 128 individually. Pressure port 127 is connected by a line 131 to the outlet of a pressure-regulating valve 132 whose inlet is connected to pressure manifold 22". Pressure regulating valve 132 has a higher pressure limit (e.g., 150 psi) than that of pressure reducing valve 119 at station 5. As indicated by the dashed line 132*a*, valve 132 senses the pressure in line 131 on its downstream side and responds to it by limiting the pressure in this line to the predetermined maximum. Drain port 128 is connected by lines 133 and 64 to reservoir 18*c*. Port 130 is connected via line 130*a* to an isolating plug 126, which clocks it. Port 129 is connected via a line 134 to the junction 135 between two flow restriction orifices 136 and 137 in a flow divider/-combiner 138.

The opposite side of the flow retriction 136 is connected to the lower port 139 of a cylinder 140 in which a piston 141 is slidable up and down. A piston rod 142 extending up from piston 141 is coupled to the second steam chest in the ironer for raising it toward the ironer rollers. Cylinder 140 has an upper port 143 which is connected by line 144 to a reservoir 18*d*, which preferably is the same reservoir as the supply reservoir 18 in FIG. 1.

The opposite side of the other flow restriction 137 in flow-divider/combiner 138 is connected to the lower port 146 of a cylinder 149, which has an upper port 147 connected by line 148 to reservoir 18*d*. a piston 150 is slidable vertically in cylinder 149 and it is coupled to the second steam chest through a piston rod 151.

The two cylinder-and--piston assemblies 140–142 and 149–151 and the second steam chest which they raise and lower may be arranged substantially as shown in FIGS. 3 and 4 of U.S. Pat. No. 4,488,365 to Charles F. Hord and William W. Allen.

When the solenoid of valve 56 is de-energized, its pressure port 127 is connected to its port 130 and its drain port 128 is connected t its port 129. When the solenoid of valve 56 is energized, its pressure port 127 is connected to its port 129 and its drain port 128 is connected to its port 130.

At station 7 the control valve 57 for the first steam chest in the ironer is a solenoid valve having a pressure port 152, a drain port 153, and two additional ports 154 and 155 which are connected alternately and reversibly to ports 152 and 153 individually. Pressure port 152 is connected by a line 156 to the outlet of a pressure regulating valve 157, the inlet of which is connected to pressure manifold 22''. Pressure regulating valve 157 has the same pressure limit as that of pressure regulating valve 132 at station 6 (higher than the pressure limit of pressure regulating valve 119 at station 5). As indicated by the dashed line **157*a*, valve 157 senses and responds to the pressure in line 156 on its downstream side. Drain port 153 is connected via line 158 to line 64 and from there to the reservoir 18*c*. Port 154 is connected via line 159 to the junction 160 between two flow restriction orifices 161 and 162 in a flow divider/combiner 163. Port 155 is connected through a line 155*a* to an isolating plug 164**, which blocks it.

The opposite side of the flow restriction 161 from junction 160 is connected to the lower port 165 of a cylinder 166 in which a piston 167 is slidable up and down. A piston rod 168 extending up from piston 167 is coupled to the first steam chest in the ironer for raising it toward the ironer rollers. Cylinder 166 has an upper port 169 which is connected by line 148 to reservoir **18*d***.

The opposite side of the other flow restriction 162 in flow divider/combiner 163 is connected to the lower port 170 of a cylinder 173, which has an upper port 171 connected by line 172 to reservoir **18*d*. A piston 174 is slidable vertically in cylinder 173 and it is coupled to the first steam chest through a piston rod 175**.

The two cylinder-and-piston assembled 166–168 and 173–175 and the first steam chest which they raise and lower may be arranged substantially as shown in FIGS. 3 and 4 of U.S. Pat. No. 4,888,365.

When the solenoid of valve 57 is de-energized, its pressure port 152 is connected to its port 155 and its drain port 153 is connected to its port 154. When the solenoid of valve 57 is energized, tis pressure port 152 is connected to its port 154 and its drain port 153 is connected to its port 155.

OPERATION

Referring to FIG. 1, the charge pump 11 draws hydraulic liquid from reservoir 18 and pumps it through cooler 20 to lines 21 and 22.

Referring to FIG. 1, when the roller drive is in neutral, the hydraulic liquid in line 21 flows through both check valves 13 and 14 to lines A' and B' to supercharge both of them. The hydraulic liquid also flows through the low pressure relief valve 17 and returns through lines 26 and 12 to reservoir 18.

Referring to FIG. 2, when the main pump 10 is running, the ironer rollers can be driven forward under the joint control of the "run/emergency stop" solenoid valve 51 and the "forward drive" solenoid valve 54. When the solenoids of both of these valves are energized, hydraulic liquid can flow from pressure manifold 22' through the "forward drive" solenoid valve 53 by way of line 92, ports 88 and 90 of valve 53, and lines 94 and 67 to port 68 of the right-hand cylinder of positioning cylinder 69, causing the piston 73 to move from right to left in FIG. 2, assuming that the piston rod 109 of speed control cylinder 107 is not in its fully-retracted position. The return flow from this cylinder is through its port 74 and line 95 to port 91 of the "forward drive" solenoid valve 53, through this valve to its outlet port 89, and via line 93, flow restriction **93*a* and line 64 to reservoir 18*c***.

In the fluid circuit shown in FIG. 2 it is essential that the solenoid of "run/emergency stop38 valve 51 be energized along with the solenoid of the "forward drive" valve 53 in order to establish the forward drive to the rollers in the ironer. If the solenoid of valve 51 were not energized, the pressure would not build up at cylinder port 68 because this port would be drained to reservoir **18*c* through lines 67 and 66, ports 60 and 59 of valve 51, and lines 63 and 64. When the solenoid of valve 51 is energized, it blocks line 66 because it then connects its port 60 to its port 58, which is connected to the isolating plug 62**.

The retraction of the positioning cylinder's piston rod **73*a* causes the adjustable body in main pump 10 (FIG. 1) to wave to a position in which this pump's port B is its inlet port and port A is its outlet port. Flow from pump 10 goes out its port A to line A', from there to port 38 of hydraulic motor 40, causing it to turn in a direction to drive the ironer rollers forward. The return flow from hydraulic motor 40 is through its port 39 and line B' to port B of main pump 10**, which at this time is its inlet port.

The rollers can be driven forward, as described, only if the piston 108 in the speed control cylinder 107 is not in its fully retracted position. As described, the piston rod 107 positions stop lever 185 and stop plate 187 to prevent the main pump's pintle 180 from being turned in the forward direction (clockwise in FIG. 3) as long as piston 108 is fully retracted.

With the solenoids of both the run valve 51 and the forward valve 53 energized, when the "faster" (lower) solenoid of the speed control valve 54 is energized, the hydraulic fluid in pressure manifold 22' flows through line 100 to pressure port 96 of speed control valve 54 and through this valve to its port 99 and line 110, which causes check valves 111 and 103 to open. From check valve 111 the hydraulic liquid flows via line 112 to port 113 of speed control cylinder 107, moving its piston 108 from right to left in FIG. 2. The return flow from this cylinder is through its port 106, flow restriction orifice 105, line 104, check valve 103, and line 102 to port 98 of speed control valve 54, through this valve to its drain port 97, and through lines 101 and 64 to reservoir **18*c*. this movement of piston 108 in speed control cylinder 107 permits the rotatably adjustable body of main pump 10 to turn to a position making port A its outlet and port B its inlet port, as described, for causing hydraulic motor 40 to drive the rollers forward. The presence of the flow restriction 105 in the return path from cylinder 106 causes its piston 108** to stroke out slowly.

To reduce the speed of the rollers, the "faster" solenoid of speed control valve 54 is de-energized and its "slower" (upper) solenoid is energized. The hydraulic fluid n pressure manifold 22' flows through line 100 to pressure port 96 of valve 54 and through this valve to its port 98 and line 102, which causes check valves 103 and 111 to open. From the outlet of check valve 103 the hydraulic liquid flows through line 104 and flow restriction 105 to port 106 of speed control cylinder 107, moving its piston 108 to the right in FIG. 2 and causing it to expel hydraulic liquid from the right end of this cylinder through port 113, line 112, the now-open check valve 111 and line 110 to port 99 of valve 54, through this valve to its drain port 97 and through lines 101 and 64 to reservoir 18c. Piston 108 strokes in slowly because of the presence of flow restriction 105 between valve 54 and cylinder port 106. The rightward movement of piston 108 in speed control cylinder 107 is imparted to piston rod 109 which causes the adjustable body of main pump 10 to turn to a position reducing the rate of flow of hydraulic liquid to and from the hydraulic motor 40 (but keeping the same direction). The hydraulic motor rotates at a reduced speed, which is imparted to the rollers of the ironer.

When a desired speed of the ironer rollers in the forward direction has been reached, this speed may be maintained by de-energizing which ever solenoid of valve 54 has been energized. With neithr solenoid of this valve energized, tis ports 98 and 99 are both connected to its dran port 97, which is connected to reservoir 18c through lines 101 and 64. This prevents the trapping of hydraulic liquid between valve 54 and check valves 103 and 111 and insures that these check valves will close properly. Even if there if leakage in valve 54, which can be expected in a spool-type solenoid valve, because the soft-seat check valves 103 and 111 are closed, hydraulic liquid is trapped in clyinder 107 and lines 104 and 112, preventing piston 108 from moving.

While the forward drive to the ironer rollers is in effect, as described, these rollers can be stopped quickly be de-energizing the solenoids of valves 51 and 53. Hydraulic liquid now flows from pressure manifold 22' through line 92 to pressure port 88 of the "forward drive" valve 53 and through this valve to its port 91 and via line 95 to port 74 of positioning cylinder 69. Hydraulic liquid on the opposite side of piston 73 can flow to reservoir 18c via lines 67 and 66, port 60 of "run/emergency stop" valve 51 and through this valve to its port 59, and via lines 63 and 64 to reservoir 18c. There is no flow restriction device in this return path through the "run/emergency stop" valve 51 whereas there is a flow restriction device 93α in the alternate return path from port 68 of the positioning cylinder 69 through the "forward drive" valve 53. The absence of such a flow restriction in the return path through valve 51 means that the piston 73 can be brought to a stop relatively quickly and reversed in its direction.

Piston 73 and piston rod 73a move to the right in FIG. 2, and through the mechanical coupling between this piston rod and the adjustable body of main pump 10, this movement causes the main pump to come to a neutral or zero flow condition. This zero flow being provided to the motor 40 brings the ironer rollers quickly to a stop. Over-run of the ironer rollers caused by rotational inertia is quickly absorbed by allowing fluid to dump over relief valves 15 and 16 (FIG. 1).

To drive the rollers in reverse, the solenoid of "reverse drive" valve 52 is energized. Hydraulic liquid from pressure manifold 22' flows through line 83 to pressure port 79 of valve 52 and through this valve to its port 81 and line 86 to port 76 of the left-hand cylinder of positioning cylinder 69, causing its piston 77 to move from right to left in FIG. 2. The return flow from this cylinder is through its port 75 and line 87 to port 82 of "reverse drive" valve 52, and through this valve to its outlet port 80, through line 84 and flow restricting orifice 85 to line 64 going to reservoir 18c.

The leftward movement of piston rod 78 causes the adjustable body of main pump 10 to move to a position in which its port A is its inlet port and port B is its outlet port. Flow from pump 10 goes out its port B to line B', from there to port 39 of hydraulic motor 40, causing it to rotate in a direction to drive the rollers in reverse. The return flow from hydraulic motor 40 is through its port 38 and line A' to port A of main pump 10, which at this time is its inlet port.

To raise the first steam chest in the ironer, the solenoid of valve 57 is energized, thereby causing this valve to connect its pressure port 152 to port 154 and to connect its port 155 to its drain port 153. Hydraulic liquid in manifold 22" flows through pressure regulating valve 157 and line 156 to port 152 of valve 57, and from there through its port 154 and line 159 to the flow divider/-combiner 163, where part goes through flow restriction 161 to the lower port 165 of cylinder 166 and the rest through flow restriction 162 to the lower port 170 of cylinder 173. Both pistons 167 and 174 are raised, and they raise the first steam chest in the ironer.

As explained hereinafter, the upward pressure on the first steam chest is determined either by pressure regulating valve 157 associated with valve 57 or by pressure regulating valve 119 associated with valve 55, depending upon whether or not the solenoid of valve 55 is energized.

When the first steam chest if fully raised, the cylinder-and-piston units 166–168 and 173–175 stall out. The hydraulic pressure from manifold 22" is dead-headed at cylinders 173 and 166 as long as the solenoid of valve 57 remains energized, so the chest is kept in its full raised position.

The first steam chest can be lowered by de-energizing the solenoid of valve 57, thereby connecting the lower ports 165 and 170 of cylinders 166 and 173 through the respective flow restrictions 161 and 162 to reservoir 18c through the path in valve 57 via its ports 154 and 153. In this condition of valve 57, its pressure port 152 is connected through port 155 and line 155a to isolating plug 164. The flow restrictions 161 and 162 retard the lowering of the pressure in cylinders 166 and 173 below their pistons 167 and 174, so these pistons descend gradually under the weight of the first steam chest.

The second steam chest in the ironer is raised by energizing the solenoid of valve 56, causing the pistons 141 and 150 in cylinders 140 and 149 to be raised in essentially the same manner as just described for pistons 167 and 174 in cylinders 169 and 173. Hydraulic liquid in manifold 22" flows through pressure regulating valve 132 and line 131 to port 127 of valve 56, through this valve to its port 129, and through line 134 to the flow divider/combiner 138, where part goes through flow restriction 136 to the lower port 139 of cylinder 140 and the rest through flow restriction 137 to the lower port 146 of cylinder 149. Both pistons 141 and 150 are raised, and they raise the second steam chest in the ironer.

The maximum upward pressure on the second steam chest is determined either by pressure regulating valve 132 associated with valve 56 or by pressure regulating valve 119 associated with valve 55, depending upon whether or not the solenoid of valve 55 is energized, as explained hereinafter.

To lower the second steam chest, the pistons 141 and 150 are lowered by de-energizing the solenoid of valve 56. Under this condition, the lower ports 139 and 146 of cylinders 140 and 149 are connected to reservoir 18*c* through the respective flow restrictions 136 and 137, line 134, port 129 of valve 56, through this valve to its port 128, and lines 133 and 64. Due to the delaying actions of the flow restrictions 136 and 137, the fluid pressure in cylinders 140 and 149 below the respective pistons gradually drops slowly and these pistons move down slowly under the weight of the second steam chest. The pressure port 127 of valve 56 is blocked at this time because valve port 130 connects it to isolating plug 126.

The maximum pressure for raising either steam chest depends upon the condition of the "energy save/normal" solenoid valve 55 at station 5.

When the solenoid of valve 55 is de-energized, the pressure regulating valve 119 between pressure manifold 22' and pressure port 114 of valve 55 determines the maximum pressure of the hydraulic liquid supplied to manifold 22'' and from there to the control valve 56 or 57 for the respective steam chest. With the solenoid of valve 55 de-energized, hydraulic liquid flows from manifold 22' through line 120, pressure regulating valve 119, and line 118 to pressure port 114 of valve 55, and through this valve to its port 117 and line 124 to the manifold 22'' that supplies valves 56 and 57. Line 122, which is dead-headed at isolating plug 123, has substantially the same pressure as on the downstream side of pressure regulating valve 119 because of the fluid connection provided by pressure port 114 and port 116 of valve 55.

With pressure regulating valve 119 set at a lower limit (e.g., 85 psi) than either pressure regulating valve 132 or 157 (e.g., 150 psi), it is valve 119 that determines the maximum pressure for operating either steam chest. This is the "energy saving" position which provides less friction between the steam chest and the roller, thus saving energy.

The "normal" mode is established by energizing the solenoid of valve 55. This puts each steam chest under the control of its respective pressure regulating valve 132 or 157 and free from the control of the pressure regulating valve 119 at station 5. When the solenoid of valve 55 is energized, the pressure sensing line 122 for pressure regulating valve 119 is connected to drain through ports 116 and 115 of valve 55. Consequently, valve 119 now does not limit the pressure delivered to its downstream side and the hydraulic pressure in manifold 22'' is substantially equal to that in manifold 22''. That is, with the solenoid of valve 55 energized, the pressure regulating valve 119 ahead of its inlet is effectively disabled from performing a pressure-regulating function in the system.

Referring to FIG. 1, when the hydraulic motor 40 is being driven in the forward direction, the outlet side of the motor is connected to drain through shuttle valve 31 (ports 32 and 34), low pressure relief valve 35 and filter 36. Excess flow from the charge pump 11 that is not required to keep the low pressure side (B') of the main pump-hydraulic motor circuit "tight"] is spilled to reservoir 18*a*. This gets hot oil out of the main pump hydraulic motor circuit.

Cooler oil gets into the main pump-hydraulic motor circuit from cooler 20 at the outlet side of the charge pump 11. In the forward drive mode, this cooled oil enters the circuit by opening check valve 13. It cannot pass through low pressure relief valve 17 because this valve is set to open at a higher pressure than low pressure relief valve 35 in the hot oil valve sub-assembly 30. Thus, the cooler oil is drawn into main pump 10 and is delivered from it to motor 40. In the reverse drive mode, cooled oil enters the circuit by opening check valve 14.

High pressure relief valves 15 and 16 protect against excessive pressures when the rollers in the ironer stall. If roller stall happens in the forward drive mode, relief valve 16 will open and dump the output from main pump 10 into its supercharge line 21. Both low pressure relief valves 17 and 35 will open, also. In the reverse drive mode, if roller stall occurs, high pressure relief valve 15 will open, as will the low pressure relief valves 17 and 35.

I claim:

1. In combination with a laundry flatwork ironer having a plurality of rollers for ironing the flatwork and advancing it through the ironer, the improvement which comprises:

a hydraulic motor having a pair of ports and a reversible displaceable means between said ports driven by a fluid pressure differential between said pair of ports, said displaceable means being operatively coupled to said rollers for driving the rollers;

a main pump having two ports connected respectively to said ports of the hydraulic motor, said pump having adjustable means for selectively making either of its said two ports the pump inlet and the other of its said two ports the pump outlet;

hydraulically-operated positioning means operatively coupled to said adjustable means in said pump to control the direction of said hydraulic motor, said hydraulically-operated positioning means comprising cylinder-and-piston means controlling the position of said adjustable means in said pump, and selectively operable valve means connected hydraulically to said cylinder-and-piston means and controlling the operation of said cylinder-and-piston means;

a second pump supplying pressurized fluid to said cylinder-and-piston means through said selectively operable valve means;

and a reservoir for hydraulic liquid;

said cylinder-and-piston means comprising a forward cylinder having first and second ports and a slidable piston between said ports;

and said selectively operable valve means comprising:

a forward valve selectively operable to connect said second pump to said first port of said forward cylinder and to connect said second port to drain;

and a run/emergency stop valve selectively operable to first and second operating conditions, said run/emergency stop valve in said first operating condition thereof blocking said first port of said forward cylinder from drain, said run/emergency stop valve in said second operating condition thereof connecting said first port to drain whereby to prevent movement of said piston toward said second port.

2. In a drive system for a laundry flatwork ironer having a plurality of rollers for ironing the flatwork and advancing it through the ironer, the combination of:

a reservoir for hydraulic liquid;

ahydraulic motor having a pair of ports and a reversible displaceable means between said ports driven by a fluid pressure fifferntial between said pair of ports, said displaceable means being operatively coupled to said rollers for driving the rollers;

a main pump having two ports connected respectively to said ports of the hydraulic motor, said pump having adjustable means for selectively making either or its said two ports the pump inlet and the other of its said two ports the pump outlet;

hydraulically-operated positioning means operatively coupled to said adjustable means in said pump to control the direction of said hydraulic motor, said hydraulically-operated positioning means comprising:

cylinder-and-piston means controlling the position of said adjustable means in said pump and comprising a forward cylinder having first and second ports and a slidable piston between said ports; and selectively operable valve means connected hydraulically to said cylinder-and-piston means and controlling the operation of said cylinder-and-piston means, said selectively operable valve means comprising:

a forward valve selectively operable to connect said second pump to said first port of said forward cylinder and to connect said second port to drain; and a run/emergency stop valve having first and second operating conditions, said run/emergency stop valve in said first operating condition thereof blocking said first port of said forward cylinder from drain, said run/emergency stop valve in said second operating condition thereof connecting said first port to drain whereby to prevent movement of said piston toward said second port;

a second pump supplying pressurized fluid to said cylinder-and-piston means through said selectively operable valve means;

conduit means connecting said forward valve to drain and having a flow restriction which slows the movement of said piston;

and conduit means connecting said run/emergency stop valve to drain and substantially free of a flow restriction which would slow the stopping of said piston when said run/emergency stop valve is actuated from said first condition to said second condition thereof.

3. A drive system according to claim 2 wherein:

said cylinder-and-piston means also comprises a reverse cylinder having first and second ports and a piston slidable between said ports;

and said selectively operable valve means also comprises:

a reverse valve selectively operable to control the hydraulic connection of said second pump to said ports of the reverse cylinder, said reverse valve having a first operation condition in which it connects said second pump to said first port of the reverse cylinder and connects said second port of the reverse cylinder to drain, whereby to move the piston in the reverse cylinder toward its second port, said reverse valve having a second operating condition in which it connects said second pump to said second port of the reverse cylinder and connects said first port of the reverse cylinder to drain, whereby to move said piston in the reverse cylinder toward its first port.

4. A combination according to claim 1 wherein:

said cylinder-and-piston means also comprises a reverse cylinder cylinder having first and second ports and a piston slidable between said ports;

and said selectively operable valve means also comprises:

a reverse valve having a pair of ports connected respectively to said ports of the reverse cylinder, said reverse valve being selectively operable atlernately to reverse the connections between said second pump and said ports of the reverse cylinder and between said ports of the reverse cylinder and drain.

5. A laundry flatwork ironer having a plurality of horizontal roller and a chest below the rollers which is vertically adjustable toward and away from the rollers in combination with a drive system which includes:

a hydraulic motor for driving the rollers;

a main pump for supplying pressurized hydraulic liquid to the motor to drive the motor, said pump having adjustable means for varying its output of said pressurized fluid to thereby control the speed of said hydraulic motor;

hydraulic cylinder-and-piston means for raising the chest;

chest control valve means having hydraulic connection to said cylinder-and-piston means;

a second pump supplying pressurized hydraulic liquid to said cylinder-and-piston means through said chest control valve means;

said chest control valve means having a first operating position in which it connects said second pump to said cylinder-and-piston means to raise the chest, said chest control valve means having a second operating position in which it connects said cylinder-and-piston means to drain and allows the chest to descend;

said hydraulic motor having a pair of ports and reversible displaceable means between said ports driven by a fluid pressure differential between said pair of ports, said displaceable means being operatively coupled to said rollers for driving the rollers;

said main pump having two ports connected respectively to said ports of the hydraulic motor, said pump having adjustable means for selectively making either of its said two ports the pump inlet and the other of its said two ports the pump outlet;

hydraulically operated cylinder-and-piston means operatively coupled to said adjustable means for the main pump to control the direction and speed of said hydraulic motor; said cylinder-and-piston means comprising:

a forward cylinder having first and second ports and a piston slidable between said ports; a reverse cylinder having first and second ports and a piston slidable between said ports; and a speed control cylinder having first and second ports and a piston slidable between said ports;

and said selectively operable valve means comprising:

a forward valve selectively operable to connect said second pump to said first port of said forward cylinder and to connect said second port of the forward cylinder to drain; a run/emergency stop valve having first and second operating conditions, said run/emergency stop valve in said first operating condition thereof blocking said first port said forward cylinder from drain, said run/emergency stop valve in said second operable condition thereof connecting said first port to drain whereby to prevent movement of said piston in the forward cylinder toward said second port of the forward cylinder;

a reverse valve selectively operable to control the hydraulic connection of said second pump to said ports of the reverse cylinder, said reverse valve having a first operating condition in which it connects said second pump to said first port of the reverse cylinder and connects said second port of the reverse cylinder to drain, whereby to move the piston in the reverse cylinder toward its second port, said reverse valve having a second operating condition in which it connects said second pump to said second port of the reverse cylinder and connects said first port of the reverse cylinder to drain, whereby to move said piston in the reverse cylinder toward its first port; and a speed control valve having a first operating condition in which it connects both ports of the speed control cylinder to drain, a second operating condition in which it connects said second pump to said first port of the speed control cylinder and connects said second port of the speed control cylinder to drain whereby to move said piston in said speed control cylinder toward its second port, and a third operating condition in which in connects said second pump to said second port of the speed control cylinder and connects said first port of the speed control cylinder to drain whereby to move said piston in the speed control cylinder toward its first port.

6. The combination according to claim 5 and further comprising additional valve means operatively connected to said chest control valve means to selectively limit the pressure of the hydraulic liquid supplied by said second pump to said cylinder-and-piston means through said chest control valve means.

7. The combination according to claim 6 and further comprising:

a solenoid valve connected between said second pump and said chest control valve means, said solenoid valve having a first operating condition and a second operating condition in each of which it controls the flow of hydraulic liquid to said chest control valve means;

a first pressure regulating valve operatively connected to said solenoid valve to (a) limit the maximum pressure of the hydraulic liquid to said chest control valve means when said solenoid valve is in said first operating condition and (b) impose no limit on said maximum pressure when said solenoid valve is in said second operating condition;

and a second pressure regulating valve connected between said solenoid valve and said chest control valve means, said second pressure regulating valve having a higher pressure limit than said pressure regulating valve and being operative to restrict the maximum pressure of the hydraulic liquid to said chest control valve means to said higher pressure limit when said solenoid valve is in said second operating condition.

8. A laundry flatwork ironer having a plurality of horizontal rollers and a chest below the rollers which is vertically adjustable toward and away from the rollers in combination with a drive system which includes:

a hydraulic motor for driving the rollers;

a main pump for supplying pressurized hydraulic liquid to the motor to drive the motor, said pump having adjustable means for varying its output of said hydraulic liquid to thereby control the speed of said hydraulic motor;

hydraulic cylinder-and-piston means for raising the chest;

chest control valve means having hydraulic connections to said cylinder-and-piston means;

a second pump supplying pressurized hydraulic liquid to said cylinder-and-piston means through said chest control valve means;

said chest control valve means having a first operating position in which it connects said second pump to said cylinder-and-piston means to raise the chest, said chest control valve means having a second operating position in which it connects said cylinder-and-piston means to drain and allows the chest to descend;

additional valve means operatively connected to said chest control valve means to selectively limit the pressure of the hydraulic liquid supplied by said second pump to said cylinder-and-piston means through said chest control valve means;

a solenoid valve connected between said second pump and said chest control valve means, said solenoid valve having a first operating condition and a second operating condition in each of which it controls the flow of hydraulic liquid to said chest control valve means;

a first pressure regulating valve operatively connected to said solenoid valve to (a) limit the maximum pressure of the hydraulic liquid to said chest control valve means when said solenoid valve is in said first operating condition and (b) impose no limit on said maximum pressure when said solenoid valve is in said second operating condition;

and a second pressure regulating valve connected between said solenoid valve and said chest control valve means, said second pressure regulating vavle having a higher pressure limit than said first pressure regulating valve and being operative to restrict the maximum pressure of the hydraulic liquid to said chest control valve means to said higher pressure limit when

9. In a laundry flatwork iron having a plurality of horizontal rollers for ironing the flatwork and advancing it through ironer, and a chest below the ironer which is vertically adjustable toward and away from rollers, the combination of:

hydraulic cylinder-and-piston means for raising the chest;

chest control valve means having hydraulic connections to said cylinder-and-piston means;

pump means supplying pressurized hydraulic liquid to said cylinder-and-piston means through said chest control valve means;

said chest control valve means having a first operating condition in which it connects said pump means to said cylinder-and-piston means to raise the chest and a second operating condition in which it connects said cylinder-and-piston means to drain and allows the chest to descend;

and additional valve means operatively connected to said chest control valve means to selectively limit the pressure of the hydraulic liquid supplied by said pump means to said cylinder-and-piston means through said chest control valve means;

said additional valve means comprising:

a solenoid valve connected between said pump means and said chest control valve means, said solenoid valve having a first operating condition and a second operating condition in each of which it controls the flow of hydraulic liquid to said chest control valve means;

a first pressure regulating valve operatively connected to said solenoid valve to (a) limit the maximum pressure of the hydraulic liquid to said chest control valve means when said solenoid valve is in said first operating condition and (v) impose no limit on said maximum pressure when said solenoid valve is in said second operating condition;

and a second pressure regulating valve connected between said solenoid valve and said chest control valve means, said second pressure regulating valve having a higher pressure limit than said first pressure regulating valve and being operative to restrict the maximum pressure of the hydraulic liquid to said chest control valve means to said higher pressure limit when said solenoid valve is in said second operating condition.

* * * * *